US007351128B1

(12) United States Patent
Burns

(10) Patent No.: US 7,351,128 B1
(45) Date of Patent: Apr. 1, 2008

(54) HOLDER FOR STUFFED TOY ANIMAL FOR USE WITH A PLANT OR FLORAL ARRANGEMENT

(76) Inventor: Judy K. Burns, 948 Masonridge Rd., St. Louis, MO (US) 63141

( * ) Notice: Subject to any disclaimer, the term of this patent is extended or adjusted under 35 U.S.C. 154(b) by 726 days.

(21) Appl. No.: 10/808,912

(22) Filed: Mar. 25, 2004

(51) Int. Cl.
*B65D 81/36* (2006.01)
*A63H 3/02* (2006.01)
*F16M 11/00* (2006.01)

(52) U.S. Cl. ..... 446/77; 446/369; 248/175

(58) Field of Classification Search ..... 446/71, 446/76, 77, 369; 40/606.11, 645; D06/556; D11/144; 211/85.23; 47/39, 41.11; 206/423, 206/457; 248/312.1, 175, 27.8, 908, 915; 428/7
See application file for complete search history.

(56) References Cited

U.S. PATENT DOCUMENTS

| | | | | |
|---|---|---|---|---|
| 1,808,292 A | | 6/1931 | Coppersmith | 40/645 |
| 1,938,736 A | * | 12/1933 | Berman | 362/122 |
| 2,211,487 A | * | 8/1940 | Baumstark | 428/25 |
| 2,730,837 A | | 1/1956 | Vaughan | 446/451 |
| 3,721,414 A | * | 3/1973 | Yoder | 248/175 |
| 4,654,991 A | * | 4/1987 | Jones | 40/617 |
| 4,749,088 A | * | 6/1988 | Workman et al. | 211/13.1 |
| 4,892,515 A | * | 1/1990 | Stiegeler | 493/386 |
| 4,949,486 A | | 8/1990 | Belokin et al. | 40/414 |
| 5,003,725 A | * | 4/1991 | Maddox | 47/39 |
| D332,237 S | * | 1/1993 | Jones et al. | D11/146 |
| D392,211 S | * | 3/1998 | Puccinelli | D11/149 |
| 5,735,075 A | * | 4/1998 | Honkawa et al. | 47/41.12 |
| 6,038,812 A | * | 3/2000 | Belokin et al. | 47/41.01 |
| 6,471,166 B1 | * | 10/2002 | Toettcher | 248/175 |
| D495,620 S | * | 9/2004 | Johnson | D11/149 |
| 2005/0039392 A1 | * | 2/2005 | Sheehan | 47/41.01 |

* cited by examiner

*Primary Examiner*—Eugene Kim
*Assistant Examiner*—Alyssa M Hylinski
(74) *Attorney, Agent, or Firm*—Grace J. Fishel

(57) ABSTRACT

A holder for efficiently and cleanly affixing a stuffed toy animal in standing position adjacent a container for a plant or floral arrangement. The holder includes a rod and first and second ribbons. The first ribbon interconnects the head of the stuffed animal and the rod, while the second ribbon is wound around the rod to secure the first ribbon and then spirals downwardly as a covering. A third ribbon may be formed into a bow and attached to the holder as decoration.

8 Claims, 5 Drawing Sheets

10
20
26
36
34
22
18
14
12
38

HOLDER FOR STUFFED TOY ANIMAL FOR USE WITH A PLANT OR FLORAL ARRANGEMENT

BACKGROUND OF THE INVENTION

1. Field of the Invention

The present invention relates to a holder for efficiently and cleanly affixing a stuffed toy animal to a plant or floral arrangement.

2. Brief Description of the Prior Art

It has become popular in the floral industry to sell plant and floral arrangements along with items that can be used after the plant or flowers have been discarded. Stuffed toy animals such as plush bears are commonly used for this purpose with the toy tied to the arrangement with a ribbon.

Florists have encountered problems selling plant and floral arrangements with a stuffed toy animal tied to the container. One disadvantage is related to the busy working environment of a typical florist store. Florists generally like arrangements that are easy to assemble regardless of the skill level of the employee assigned to the task. Making a pretty assemblage with a tied on stuffed toy animal is an inefficient and time consuming trial and error process sometimes resulting in an arrangement of questionable quality and deliverability.

Another problem with tying the toy to the arrangement is in delivery. Sometimes the ribbon gets untied and the stuffed toy animal is separated from the arrangement. Now the delivery person has to handle two items or try to reassemble the arrangement, a task for which the person may not be trained. Other times, the delivery person may entirely forget to deliver the stuffed toy animal with the floral arrangement. Taping a toy such as a plush bear to the arrangement is not a reasonable alternative as the tape would leave an unattractive sticky residue on the toy.

BRIEF SUMMARY OF THE INVENTION

In view of the above, it is an object of the present invention to provide a means to efficiently and cleanly affix a stuffed toy animal to a plant or floral arrangement in a manner that the toy is not easily separated from the arrangement during delivery. It is another object to provide a holder for a stuffed toy animal that can be used to make a pretty arrangement regardless of the skill level of the person assigned to the task or how hectic the florist shop becomes. Other objects and features of the invention will be in part apparent and in part pointed out hereinafter.

In accordance with the invention, a holder is provided for efficiently and cleanly affixing a stuffed toy animal in standing position adjacent a container for a plant or floral arrangement. The holder includes a rod and first and second ribbons. A third ribbon formed into a bow may be attached to the second ribbon at the top of the rod as decoration.

The rod is elongated for insertion into the container and of a length such that it extends above a top of the container and above the stuffed toy animal in standing position. The first ribbon is connected to the top of the rod and to the head of the stuffed toy animal. The second ribbon is wrapped around the top of the rod for securing the first ribbon to the top of the rod and then spirals downward around an upper portion of the rod to form a decorative covering.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
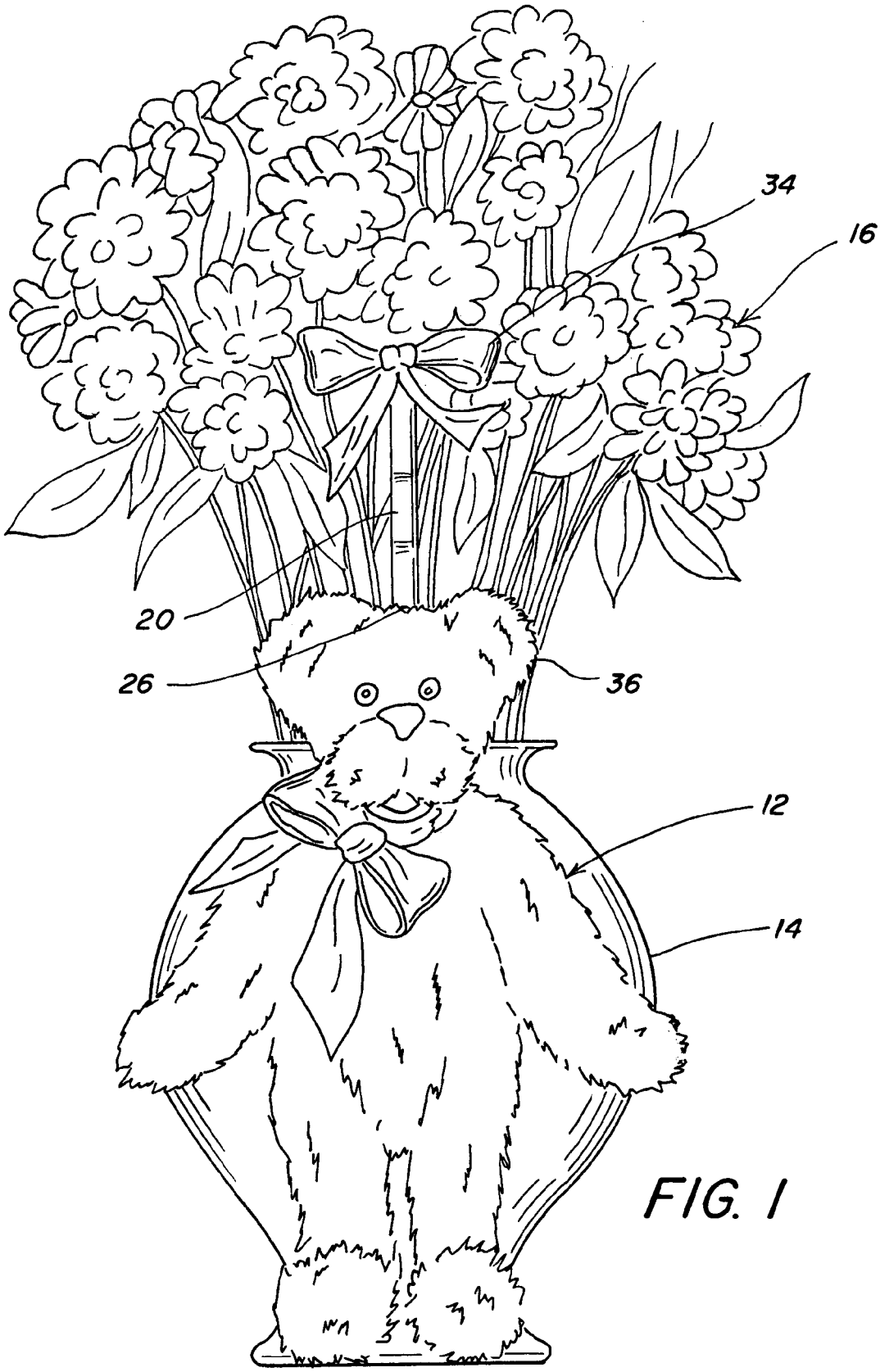
FIG. 1 is a front elevation of a holder in accordance with the present invention supporting a plush bear adjacent to a vase containing a floral arrangement.
Figure 2:
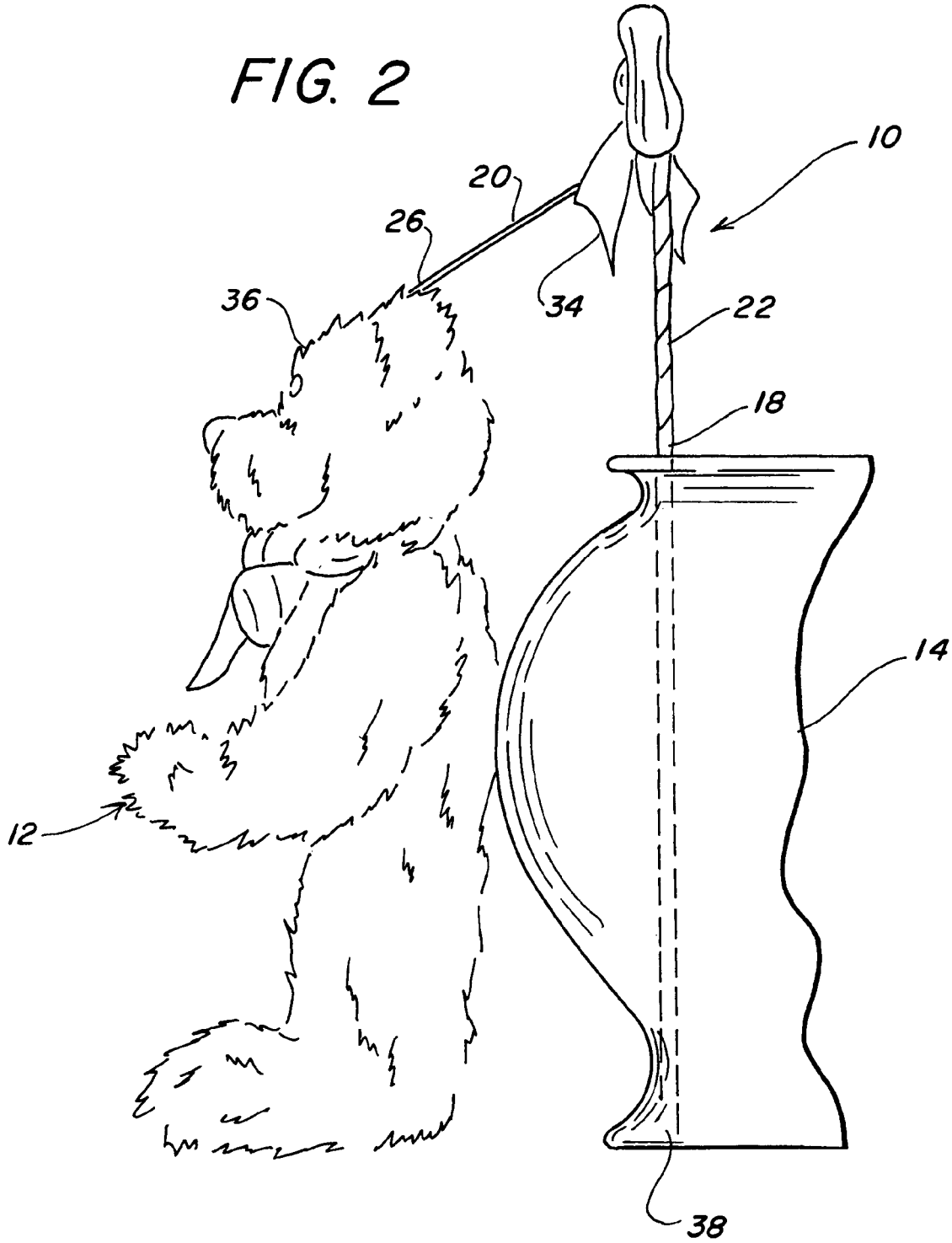
FIG. 2 is a side elevation of the holder, plush bear and floral arrangement shown in FIG. 1.

Referring to FIGS. 1-2, reference number 10 refers to a holder in accordance with the present invention for affixing a stuffed toy animal 12 to a container 14 for a plant or floral arrangement 16. In order to understand the present invention it is necessary to understand how holder 10 is constructed.

Figure 3A:
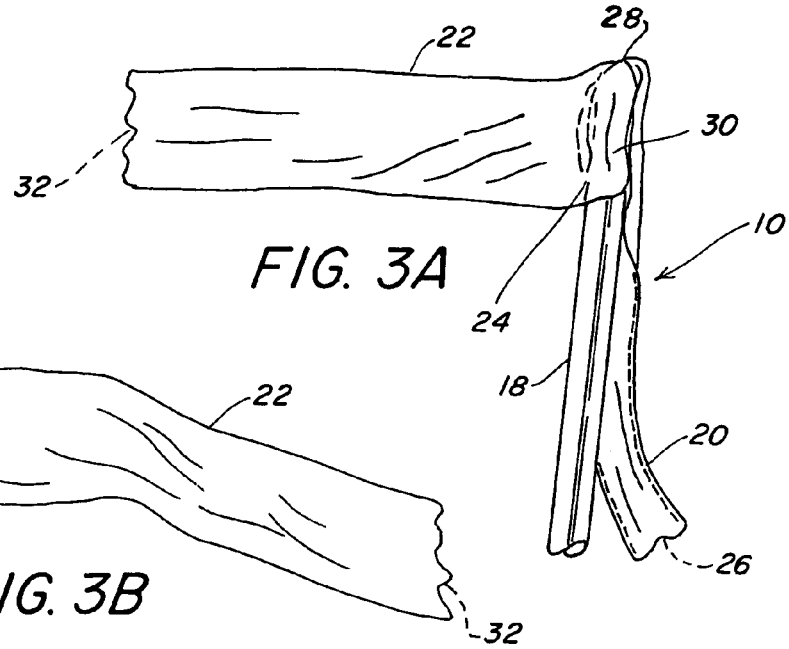
FIGS. 3A-3H illustrate how the holder is constructed from a rod and first and second ribbons.

Referring to FIGS. 3A-3H, holder 10 comprises an assemblage of a rod 18 and first and second ribbons 20, 22, respectively, as shown and described. Rod 18 is formed of a material which can be cut with a florist's pruning shears such as a wooden dowel, plastic stick, length of wire or the like. As shown in FIG. 3A, first ribbon 20 has first and second ends 24, 26, respectively. First ribbon 20 is looped over a top end 28 of rod 18 and first end 24 is attached to a side wall of rod 18 near top end 28.

Figure 3B:
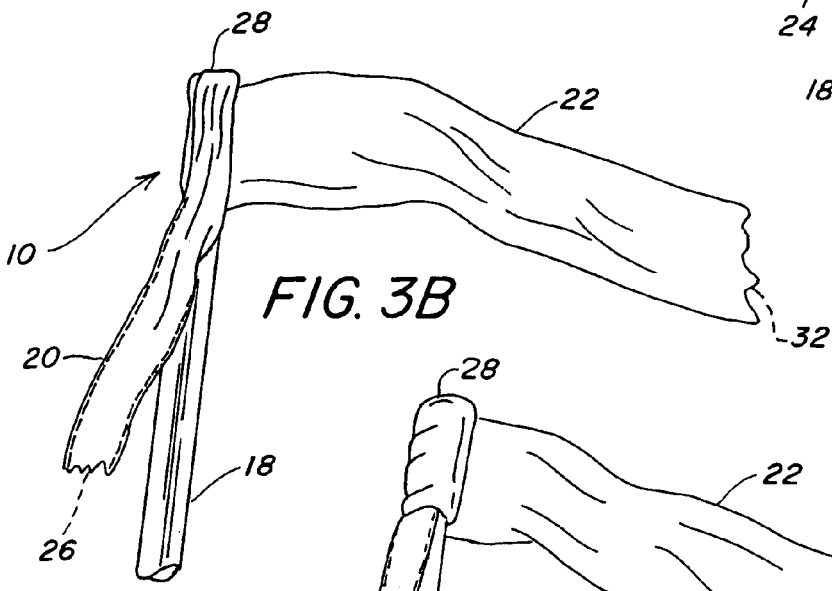
Figure 3C:
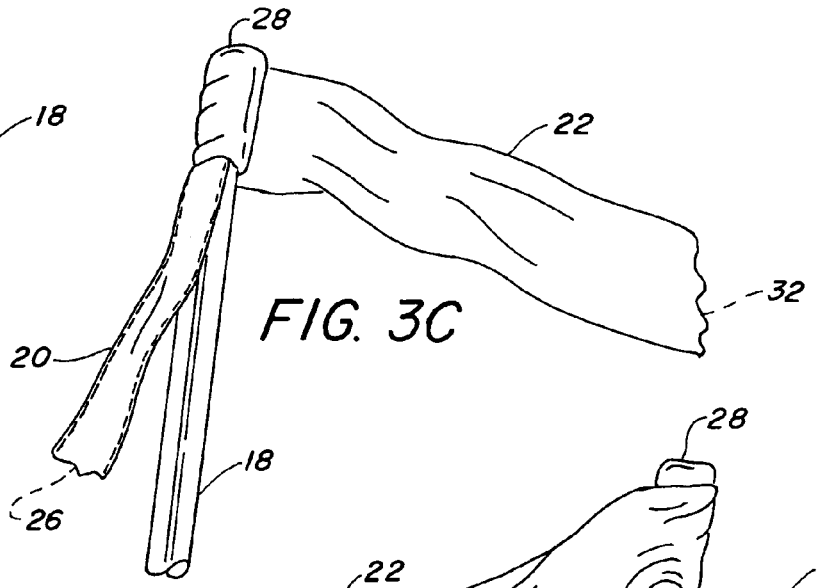
Figure 3D:
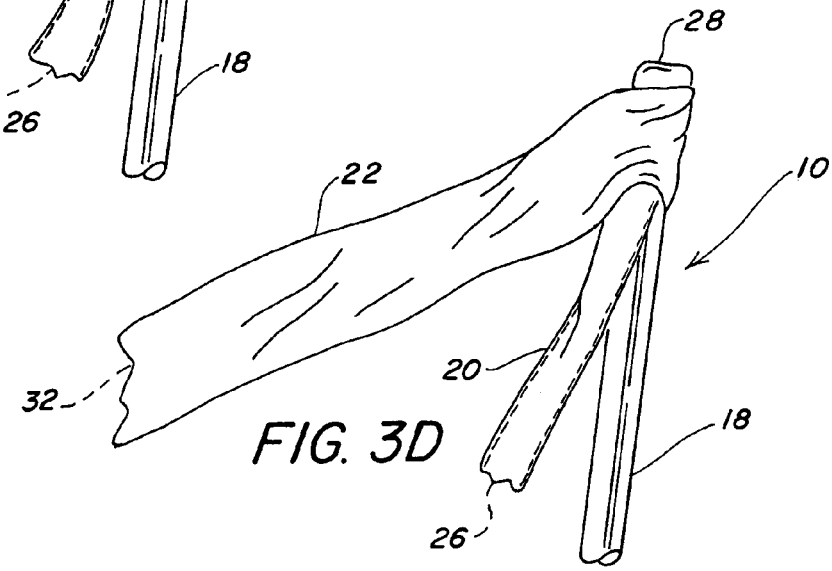
Figure 3E:
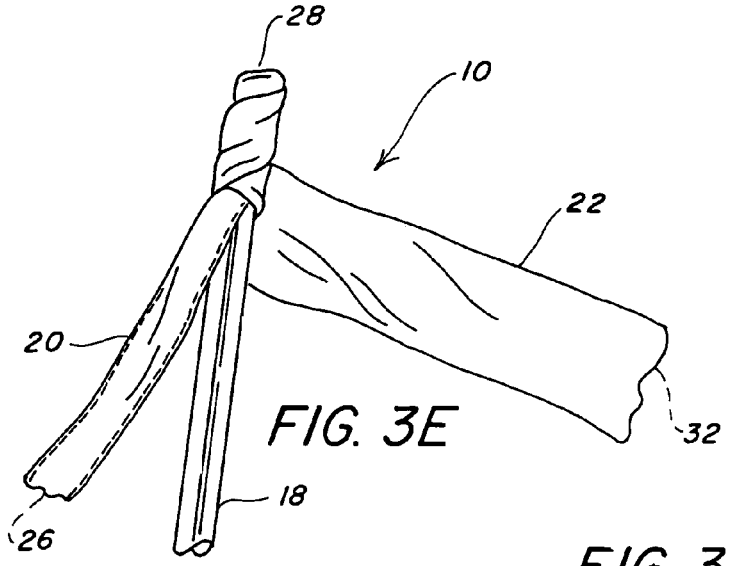

With continuing reference to FIG. 3A, second ribbon 22 has first and second ends 30, 32, respectively. First end 30 is attached to rod 18 near top end 28 and then passed, as shown in FIG. 3B around rod 18 overlapping first end 24 of first ribbon 20. Second ribbon 22 is then passed a second time around rod 18 as shown in FIG. 3C. Passing through FIG. 3D, after the third wrap around rod 18 as shown in FIG. 3E, second ribbon 22 passes under first ribbon 20 as shown in FIG. 3F.

Figure 3G:
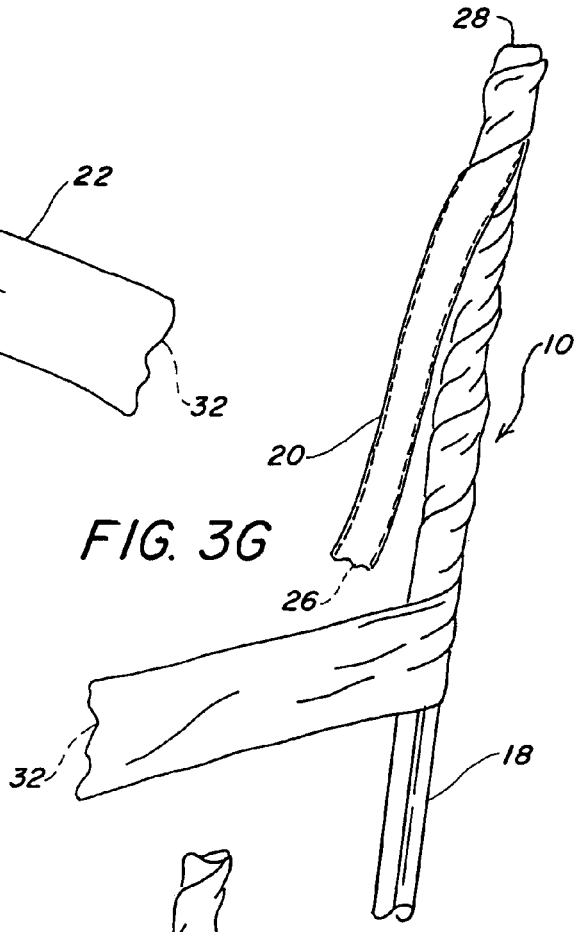
Figure 3F:
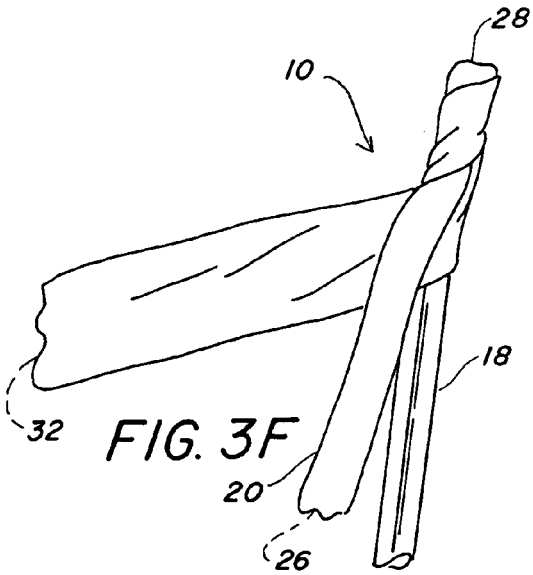
Figure 3H:
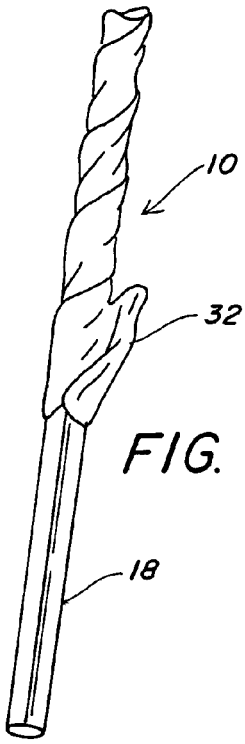
Figure 3I:
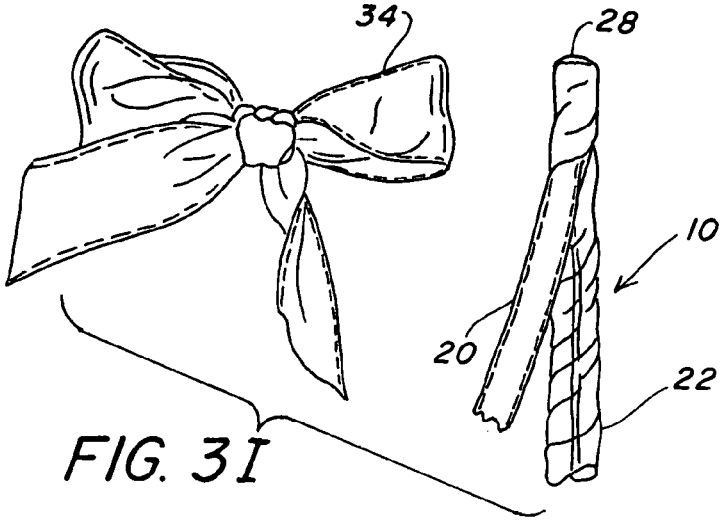
FIG. 3I illustrates the attachment of a third ribbon to the holder.
Figure 3J:
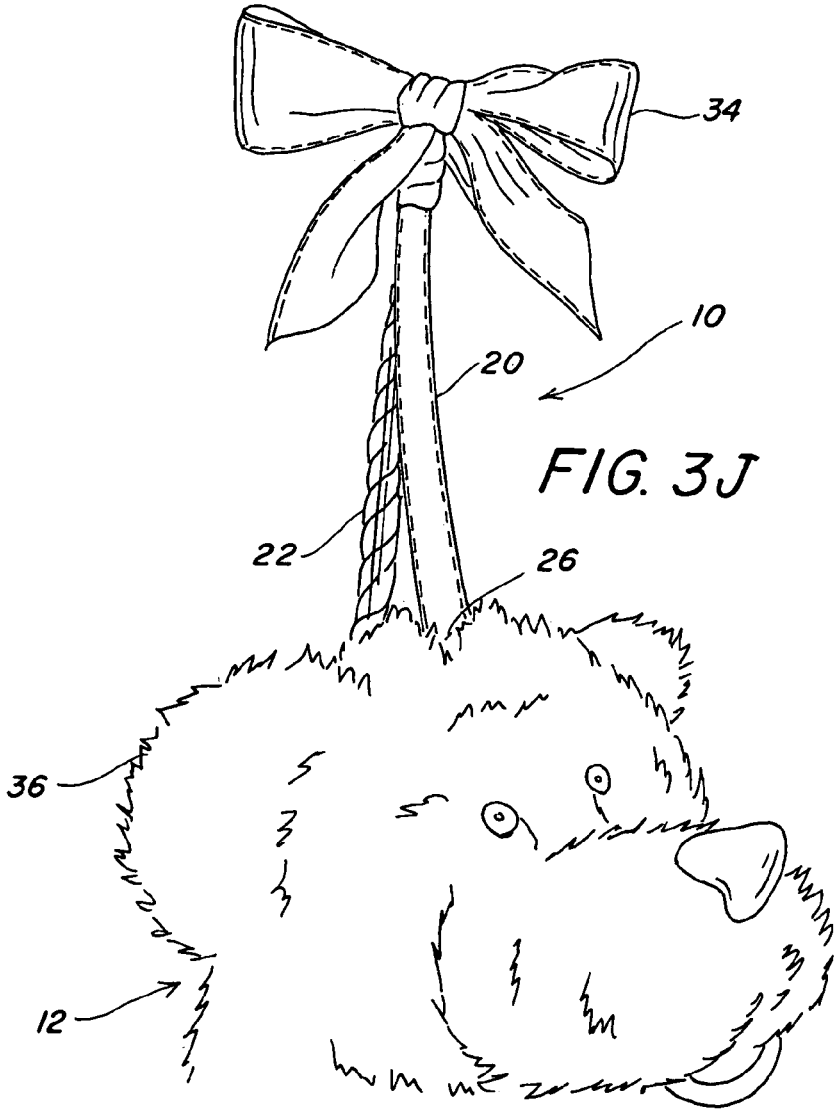
FIG. 3J illustrates the attachment of the first ribbon to a head of the plush bear.

As shown in FIG. 3G, second ribbon 22 is then spiraled partway down rod 18 and second end 32 is attached to rod 18 as shown in FIG. 3H. Second ribbon 22 may not be spiraled all the way down rod 18 so that the fabric does not wick up moisture and wet stuffed toy animal 12. If desired, a third ribbon 34 may be formed into a bow as shown in FIG. 3I and attached as shown in FIG. 3J to second ribbon 22 where it is wrapped around first ribbon 20 at top end 28 of rod 18.

Suitable means for the above-mentioned attachments (e.g., first end 24 of first ribbon 20 to rod 18, etc.) include glue, staples and the like. As shown in FIG. 3J, second end 26 of first ribbon 20 is attached to a head 36 of stuffed toy animal 12. In this instance, the attachment means include stitches and the other attachment means discussed above.

In use, after holder 10 is assembled, it is easy to make an attractive plant or floral arrangement with a stuffed toy animal attached. After plant or floral arrangement 16 has been formed, holder 10 with a stuffed toy animal 12 attached may be stood up beside container 14 to measure the length of rod 18 necessary to position stuffed toy animal 12 in standing position when rod 18 is inserted into container 14 as shown in FIGS. 1-2. If necessary, a bottom end 38 of rod 18 may be trimmed with florist's pruning shears or some other cutting means such as a saw, wire cutter, etc. After this adjustment, if needed, bottom end 38 of rod is inserted into container 14 whereupon toy stuffed animal 12 is brought into standing position adjacent container 14. A pretty arrangement is easy to make regardless of the skill level of the employee assigned to the task and how hectic the florist shop becomes.

When plant or floral arrangement 16 is delivered, there is little or no chance that toy stuffed animal 12 can become separated. And when plant or floral arrangement 16 is no longer fresh, a recipient can pull rod 18 from container 14 and reinsert it into another container as decoration. On the other hand, if the recipient no longer wants holder 10, stuffed toy animal 12 can be detached from first ribbon 20 and saved as a memento or used in the usual manner.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A holder for efficiently and cleanly affixing a stuffed toy animal in standing position adjacent a container for a plant or floral arrangement comprising:

an elongated rod for insertion into the container, said rod when inserted into said container extending above a top of the container and above the stuffed toy animal in standing position;

a first ribbon attached to the top of the rod for attachment to the stuffed toy animal to support said stuffed toy animal in standing position adjacent the container, said first ribbon having first and second ends and being folded over the top of the rod, said first end glued to the rod and said second end attached to the stuffed toy animal; and, a second ribbon wrapped around the top of the rod for securing the first ribbon to the top of the rod and spiraling downward around an upper portion of the rod to form a decorative covering.

2. The holder of claim 1 wherein the second ribbon has first and second ends and the first end is glued to the top of the rod and wherein the second ribbon passes under the first ribbon as the second ribbon spirals down the upper portion of the rod.

3. The holder of claim 2 wherein the second end of the second ribbon is glued to the rod.

4. The holder of claim 3 wherein the second end of the first ribbon is stitched to a head of the stuffed bear.

5. The holder of claim 4 wherein the rod can be cut to reduce its length to accommodate display of the stuffed bear with containers of different height.

6. A holder for efficiently and cleanly affixing a stuffed bear in standing position adjacent a container for a plant or floral arrangement comprising:

an elongated rod for insertion into the container, said rod when inserted into said container extending above a top of the container and above the stuffed toy animal in standing position;

a first ribbon attached to the top of the rod for attachment to the stuffed toy animal to support said stuffed toy animal in standing position adjacent the container, said first ribbon having first and second ends and being folded over the top of the rod, said first end glued to the rod and said second end attached to the stuffed toy animal;

a second ribbon wrapped around the top of the rod for securing the first ribbon to the top of the rod and spiraling downward around an upper portion of the rod to form a decorative covering; and, a third ribbon formed into a bow and attached to the second ribbon where it is wrapped around the top of the rod for securing the first ribbon to the top of the rod.

7. The holder of claim 6 wherein the second ribbon has first and second ends and the first end is glued to the top of the rod and wherein the second ribbon passes under the first ribbon as it spirals down the upper portion of the rod.

8. The holder of claim 7 wherein the second end of the second ribbon is glued to the rod.

* * * * *